US007405546B2

(12) United States Patent
Amrani et al.

(10) Patent No.: US 7,405,546 B2
(45) Date of Patent: Jul. 29, 2008

(54) STANDARD CMOS LOW-NOISE HIGH PSRR LOW DROP-OUT REGULATOR WITH NEW DYNAMIC COMPENSATION

(75) Inventors: Hafid Amrani, Marseille (FR); Hubert Cordonnier, Marseille (FR); Xavier Rabeyrin, Aubagne (FR)

(73) Assignee: Atmel Corporation, San Jose, CA (US)

( * ) Notice: Subject to any disclaimer, the term of this patent is extended or adjusted under 35 U.S.C. 154(b) by 370 days.

(21) Appl. No.: 11/119,130

(22) Filed: Apr. 29, 2005

(65) Prior Publication Data

US 2006/0170404 A1 Aug. 3, 2006

(30) Foreign Application Priority Data

Jan. 28, 2005 (FR) ..... 05 00890

(51) Int. Cl.
*G05F 1/575* (2006.01)

(52) U.S. Cl. ..... 323/273; 323/280

(58) Field of Classification Search ..... 323/266, 323/270, 273, 274, 275, 280, 282, 284, 351
See application file for complete search history.

(56) References Cited

U.S. PATENT DOCUMENTS

| | | | | |
|---|---|---|---|---|
| 5,889,383 | A | 3/1999 | Wrathall | 323/282 |
| 5,945,818 | A | 8/1999 | Edwards | 323/273 |
| 6,177,838 | B1 * | 1/2001 | Chiu | 330/253 |
| 6,188,211 | B1 | 2/2001 | Rincon-Mora et al. | 323/280 |
| 6,300,749 | B1 | 10/2001 | Castelli et al. | 323/273 |
| 6,304,131 | B1 * | 10/2001 | Huggins et al. | 327/538 |
| 6,373,233 | B2 | 4/2002 | Bakker et al. | 323/282 |
| 6,556,083 | B2 | 4/2003 | Kadanka | 330/292 |
| 6,603,292 | B1 | 8/2003 | Schouten et al. | 323/277 |
| 6,700,361 | B2 | 3/2004 | Gregorius | 323/282 |
| 6,710,583 | B2 | 3/2004 | Stanescu et al. | 323/280 |
| 6,960,907 | B2 * | 11/2005 | Poss | 323/316 |
| 6,977,490 | B1 * | 12/2005 | Zhang et al. | 323/280 |
| 7,091,709 | B2 * | 8/2006 | Suzuki | 323/274 |
| 7,113,039 | B2 * | 9/2006 | Zanchi | 330/252 |
| 2004/0004468 | A1 | 1/2004 | Dearn et al. | 323/280 |
| 2004/0164789 | A1 | 8/2004 | Leung et al. | 327/546 |

FOREIGN PATENT DOCUMENTS

EP 0 862 102 9/1998

OTHER PUBLICATIONS

G.A. Rincon et al., "A Low-Voltage, Low Quiescent Current, Low Drop-Out Regulator", IEEE J. Solid-State Circuits, vol. 33, No. 1, Jan. 1998, pp. 36-44.

H. Amrani et al., "A New 100KHz Low-Noise, High PSRR, Low Drop-out Regulator" submitted to IEEE Transactions on Circuits and Systems, 14 pages.

(Continued)

*Primary Examiner*—Adolf Berhane
(74) *Attorney, Agent, or Firm*—Schwegman, Lundberg & Woessner P.A.

(57) ABSTRACT

A voltage regulator circuit has a first amplifier stage with input and output terminals, a feedback terminal, a pole-inducing transistor, and a compensating network coupled to the output terminal. A second amplifier stage has an input coupled to the first amplifier output, first and second current mirrors, and a pass transistor.

17 Claims, 4 Drawing Sheets

OTHER PUBLICATIONS

G.A. Rincon-Mora et al., "Optimized Frequency Shaping Circuit Topologies for LDOs", IEEE Transactions on Circuits and Systems II, Jun. 1998, 18 pages.

G.A. Rincon-Mora, "Active Capacitor Multiplier in Miller-Compensated Circuits", IEEE Transactions on Solid-State Circuits, vol. 35, No. 1, Jan. 2000, pp. 26-32.

T. Regan, "Low Dropout Linear Regulators Improve Automotive And Battery-Powered Systems", Powerconversion and Intell. Motion, Feb. 1990, pp. 65-69.

J. Wong, A Low-Noise Low Drop-Out Regulator for Portable Equipment, Powerconversion and Intell. Motion, May 1990, pp. 38-43.

* cited by examiner

STANDARD CMOS LOW-NOISE HIGH PSRR LOW DROP-OUT REGULATOR WITH NEW DYNAMIC COMPENSATION

TECHNICAL FIELD

The present invention is related to integrated circuits. More specifically, the present invention is an apparatus and method for a voltage regulator circuit.

BACKGROUND ART

Low drop-out (LDO) voltage regulators are implemented in a variety of circuit applications to provide regulated power supplies. Increased regulator performance is especially being demanded in mobile battery-operated products such as cellular phones, pagers, camcorders, and laptop computers. For these products, regulators having a high power supply rejection ratio (PSRR) to yield low noise and ripple are needed. Regulators of this type are preferentially fabricated in standard low-cost CMOS processes, making them difficult to realize with the required performance characteristics.

A journal publication entitled "A Low-Noise High PSRR, Low Quiescent Current, Low Drop-out Regulator" by Hafid Amrani et al. states that regulators with high PSRR require a first stage amplifier with a large gain-bandwidth product. The gain-bandwidth product of an amplifier is the product of the amplifier's dc gain and its cutoff frequency, which for LDO applications is typically 1 MHz or lower. The required first stage amplifier performance can be achieved by a large dc gain, or by a high cutoff frequency.

A first journal publication entitled "A Low-Voltage, Low Quiescent Current, Low Drop-Out Regulator" by Gabriel A. Rincon-Mora and Phillip E. Allen proposes a circuit structure using a current efficient buffer and a current boosted pass device to realize a low quiescent current LDO regulator for low voltage operation.

A second journal publication entitled "Optimized Frequency Shaping Circuit Topologies for LDOS" by Gabriel A. Rincon-Mora and Phillip E. Allen proposes a circuit structure using pole-zero doublet generation to increase the bandwidth for dynamic load regulation.

A third journal publication entitled "Active Capacitor Multiplier in Miller-Compensated Circuits" by Gabriel A. Rincon-Mora and Phillip E. Allen proposes a circuit structure using Miller capacitor multipliers to reduce the silicon area consumed by a voltage regulator.

The main drawbacks of these proposed methods are:

1. The current efficient buffer circuit requires NPN bipolar transistors to avoid creation of a parasitic pole at the output of an error amplifier within the circuit.

2. The structure based on the pole-zero doublet can be stabilized if the dc open-loop gain is relatively small (e.g., 50 dB for a high current load). However, since the dc value of the PSRR is proportional to the inverse of the open-loop gain of the regulator, the dc value of the PSRR for this design cannot exceed 50 dB.

3. The Miller compensation method creates an internal pole. To make the cutoff frequency of the PSRR as high as possible, the pole of the first stage has to be as high as possible. Thus, the PSRR performance of this circuit structure is compromised. The noise performance of the regulator is also reduced.

With reference to FIG. 1, a low drop-out (LDO) regulator circuit 100 as known in the prior art comprises a first amplifier stage 110 and a second amplifier stage 120. The first amplifier stage 110 includes PMOS transistors P112, P116, and P118, diode-connected NMOS transistor N116 and NMOS transistor N118. The second amplifier stage 120 includes diode-connected PMOS transistors P122 and P126, PMOS transistor P124, diode-connected NMOS transistor N124 and NMOS transistors N122 and N126. The second amplifier stage 120 further includes PMOS power transistor P128. Resistive divider circuit comprising a resistor R1 and a resistor R2 is coupled to an output controlled voltage node $V_{OUT}$. The ratio of the resistor R1 to the resistor R2 controls a proportion of the potential on the output controlled voltage node $V_{OUT}$ which is fed back to the first amplifier stage. By varying the resistor R1 and the resistor R2, the output voltage of the regulator circuit 100 can be programmed. A current load $I_L$ is coupled to the output controlled voltage node $V_{OUT}$, representing an electrical load being powered by the regulator circuit 100 and requiring a consistent operating voltage. An external decoupling capacitance $C_L$ with an associated equivalent series resistance (ESR) $R_S$ is connected in parallel with the current load $I_L$. Skilled artisans will recognize that a plurality of applications exist, such as the operation of microprocessor circuits, mixed signal circuits, memory circuits, and others, which can replace the generic current load $I_L$ attached to the regulator circuit 100 in practical use.

An analysis of the regulator circuit 100 operation now follows the assumptions and methods in the cited journal publications. A low-valued equivalent series resistance (ESR) $R_S$ is assumed for the external decoupling capacitance $C_L$, which improves the transient ripple of the regulator. A zero introduced by the external decoupling capacitance $C_L$ and the equivalent series resistance (ESR) $R_S$ into the system transfer function is therefore at a higher frequency than the unity gain frequency (UGF) of the open-loop, and does not alter the stability of the regulator circuit 100.

As described in the journal article by Hafid Amrani et al., a dominant pole $p_1$ of the regulator response is determined by the external decoupling capacitance $C_L$ as:

$$p_1 = \frac{gd_{P128} + \left(\frac{1}{R1 + R2}\right)}{2\Pi C_L} \tag{1}$$

In formula (1), $gd_{P128}$ represents the output admittance of PMOS power transistor P128. The output admittance $gd_{P128}$ can be expressed as a function of the current load $I_L$ and a channel modulation parameter, λ, of PMOS power transistor P128:

$$gd_{P128} = \lambda * I_L \tag{2}$$

For a current load $I_L$ that is much larger than $$\left(\frac{1}{R1 * R2} * \frac{1}{\lambda}\right),$$

the pole frequency can be approximated as:

$$p_1 \approx \frac{\lambda * I_L}{2\Pi C_L} \tag{3}$$

For a typical CMOS process, λ is of the order of $0.1\ V^{-1}$ and typical low-noise regulator applications employ a resistive divider such that (R1+R2) is of the order of 100 kΩ. Under these conditions, formula (3) is valid for load currents which are large in comparison with approximately 100 μA. Thus, for a current load $I_L$ of 1 mA or more, the dominant pole of the open-loop transfer function increases with increasing current.

The dc gain, $G_{DC}$, of the open-loop transfer function of the regulator circuit 100 can be expressed as:

$$G_{DC} = \frac{gm_{P118}}{gd_{P118} + gd_{N118}} * \frac{k_1 * k_2}{a} * \frac{gm_{N122}}{gd_{P128} + \frac{1}{R1 + R2}} * \frac{R2}{R1 + R2} \quad (4)$$

with:

$$gm_{N122} = \sqrt{2 * K_n * \frac{I_L * a}{k_1 * k_2} * \frac{W_{N122}}{L_{N122}}} \quad (5)$$

In formulae (4) and (5), gm represents the transconductance of the associated subscripted transistor name, e.g., $gm_{P118}$ represents the transconductance of PMOS transistor P118. Analogously, gd represents the output admittance of the associated subscripted transistor name, e.g., $gd_{P118}$ represents the output admittance of PMOS transistor P118. The parameters $k_1$ and $k_2$ represent width ratios of current mirror transistors, such that $k_1 = W_{P124}/W_{P122}$ and $k_2 = W_{N126}/W_{N124}$, where W indicates the channel width of the associated subscripted transistor name.

The variable L in formula (5) represents the channel length of the associated subscripted transistor name, i.e., $L_{N122}$ is the channel length of the NMOS transistor N122. The parameter $K_n$ in formula (5) is the transconductance parameter for the NMOS transistors, and can be further represented as $K_n = \mu_n * C_{ox}$, where $\mu_n$ is the carrier mobility for electrons and $C_{ox}$ is the capacitance per unit area of the gate oxide. The parameter α is a fraction of the current load $I_L$ flowing in PMOS transistor P126. It is also equal to a width ratio of the diode-connected PMOS transistor P126 and the PMOS power transistor P128. Both the diode-connected PMOS transistor P126 and the PMOS power transistor P128 are designed with the same channel length to facilitate current matching, i.e., $L_{P126} = L_{P128}$ and $\alpha = W_{P126}/W_{P128}$.

Using the approximation given by formula (3), and combining formulae (2) and (5) into (4) gives $G_{DC}$ as a decreasing function of $I_L$:

$$G_{DC} = \frac{gm_{P118}}{gd_{P118} + gd_{N118}} * \sqrt{\frac{2 * Kn * \frac{k_1 * k_2}{a}}{\lambda}} * \frac{R2}{R1 + R2} * \frac{1}{\sqrt{I_L}} \quad (6)$$

A second pole p2 is introduced into the regulator open-loop response as a result of the large output impedance of the first amplifier stage 110 and an input capacitance $C_{N122}$, associated with the second amplifier stage 120. The second pole p2 value can be expressed as:

$$p_2 = \frac{gd_{P118} + gd_{N118}}{2\Pi C_{N122}} \quad (7)$$

The capacitance $C_{N122}$ is determined by the gate-to-source capacitance and Miller gate-to-drain capacitance of the NMOS transistor N122 according to:

$$C_{N122} = \sqrt{Cgs_{N122} + Cgd_{N122} * \frac{k1 * k2}{a} * \frac{K_n}{K_p} * \frac{W_{N122}}{W_{P128}} * \frac{L_{P128}}{L_{N122}}} \quad (8)$$

In formula (8) $K_p = \mu_p * C_{ox}$ is the transconductance parameter for PMOS transistors, $\mu_p$ is the carrier mobility for holes, and $C_{ox}$ is the capacitance per unit area of the gate oxide. $Cgs_{N122}$ is the gate-to-source capacitance for NMOS transistor N122 and $Cgd_{N122}$ is the gate-to-drain capacitance for NMOS transistor N122.

Formula (8) shows that $C_{N122}$, and thus p2, are not a function of current load $I_L$, whereas the dominant pole p1 and the dc gain $G_{DC}$ depend upon $I_L$. In standard CMOS processes, pole p2 is typically at a frequency lower than 100 kHz, and therefore below the unity gain frequency. This makes the system transfer function second order and unstable. As previously mentioned, and discussed in the journal article by Hafid Amrani et al., to maintain adequate power supply rejection ratio (PSRR) performance, the regulator circuit 100 configures the first amplifier stage 110 with high dc gain. For maximum stability, the pole $P_2$ is preferably as high in frequency as possible. The approach employed in the regulator circuit 100 is to add a zero in the feedback loop to stabilize the system. The zero is implemented by means of zero stabilizing resistor R115 and zero stabilizing capacitor C115 at the output of the first amplifier stage 110. The resistor R115 and the capacitor C115 series configuration create a pole-zero doublet (pc, zc) in the open-loop transfer function. The zero zc is placed after the unity gain frequency (UGF) such that the open-loop gain crosses the 0 dB axis with a −20 dB per decade slope. The zero stabilizing capacitor C115 is chosen to have a low value to reduce the frequency of the pole p2 of the first amplifier stage 110 according to:

$$p2 = \frac{1}{2\Pi} * \frac{1}{\frac{C_{N122} + C115}{gd_{P118} + gd_{N118}} + R115 * C115} \quad (9)$$

The pole-zero doublet (pc, zc) can be expressed as:

$$zc = \frac{1}{2\Pi C115 * R115} \quad (10)$$

$$pc = zc\left(1 + \frac{C115}{C_{N122}} * [1 + (gd_{P118} + gd_{N118}) * R115]\right) \quad (11)$$

Like pole p2, pc and zc are independent of the current load $I_L$. Comparison of formulae (9), (10), and (11) shows that p2<zc<pc. Therefore, the regulator is stable regardless of the value of the current load $I_L$. The system transfer function becomes locally a first order transfer function.

In addition to the discussions supra, the first journal publication by Gabriel A. Rincon-Mora and Phillip E. Allen explains that a third pole p3 is realized by the gate node of the PMOS output transistor P128. By application of a boost technique described in the first publication, pole p3 can easily be increased in frequency beyond the unity-gain frequency (UGF) of the open-loop system such that pole p3 does not alter system stability. To apply the boost technique in the regulator circuit 100 a fraction of the current load $I_L$ is sourced into the bulk terminal (not shown) of the diode-connected PMOS transistor P126. Typically, the current fraction is between 1/1000 and 1/100. By sourcing current into the bulk terminal of the diode-connected PMOS transistor P126, the threshold voltage of the diode-connected PMOS transistor P126 and the PMOS power transistor P128 is effectively lowered, producing an increase in the conductance of PMOS power transistor P128 and an increase in the associated pole p3 frequency. Additionally, the current mirrors of ratio $k_1$ and $k_2$ are implemented to reduce the current in the NMOS transistor N122. Reduction of the current in the NMOS transistor N122 enables the W/L ratio $W_{N122}/L_{N122}$ to be reduced, thereby reducing the $C_{N122}$ capacitance. Reference to formula (7), supra, shows that reduction in the $C_{N122}$ capacitance raises the pole p2 frequency. The higher pole p2 frequency enables zc to be increased in frequency, permitting a reduction in zero stabilizing resistor R115 and zero stabilizing capacitor C115 values.

The architecture of the regulator circuit 100 results in the gate node of PMOS power transistor P128 acting as a low impedance net due to the action of the diode-connected PMOS transistor P126 according to the relation:

$$gm_{P126} = a * \sqrt{2 * Kp * I_L * \frac{W_{P128}}{L_{P128}}} \tag{12}$$

The boost technique consists of increasing α, thereby increasing $gm_{P126}$. The third pole value can be expressed as a function of current load $I_L$:

$$p3 = \frac{1}{2\Pi} * a * \frac{\sqrt{2 * Kp * \frac{W_{P128}}{L_{P128}}}}{Cgs_{P128} + Cgd_{P128}} * \sqrt{I_L} \tag{13}$$

In formula (13), $Cgs_{P128}$ is the gate-to-source capacitance of PMOS power transistor P128 and $Cgd_{P128}$ is the gate-to-drain capacitance of the PMOS power transistor P128.

The PMOS power transistor P128 operates in the saturation region, so the following relations apply:

$$Cgs_{P128} = \frac{2}{3} * Cox * W_{P128} * L_{P128} \tag{14A}$$

$$Cgd_{P128} = \frac{1}{3} * Cox * W_{P128} * L_{P128} \tag{14B}$$

Applying formulae (14A) and (14B) to formula (13) gives:

$$p3 = \frac{1}{2\Pi} * \frac{a}{Cox * L_{P128}} * \sqrt{\frac{2 * Kp}{W_{P128} + L_{P128}}} * \sqrt{I_L} \tag{15}$$

Formula (15) shows that the third pole p3 is an increasing function of the current load $I_L$. The current ratio α is preferentially large enough to ensure p3 is higher than the unity-gain frequency (UGF) of the open-loop, so that p3 does not alter the regulator stability. Increasing the current ratio a requires a compromise between the phase margin and the current efficiency performance of the regulator circuit 100.

To recapitulate the analysis, supra, transfer function pole p2, zero zc, and pole pc have been shown to be independent of $I_L$ by formulae (9), (10), and (11) respectively. However, the dc gain $G_{DC}$ is a function of $$\frac{1}{\sqrt{I_L}}$$

as shown by formula (6), and the dominant pole p1 is a function of $I_L$ as shown by formula (3). The unity gain frequency (UGF) of the open-loop varies with a factor of $\sqrt{I_L}$ as:

$$UGF = (G_{DC} * p1)\left(\frac{p2}{zc}\right) \tag{16}$$

Formula 16 implicitly shows that the unity gain frequency (UGF) and hence the regulator stability, depends on the current load $I_L$. It becomes difficult to maintain stability when large variations in current load $I_L$ are desired.

What is needed, therefore, is a method of realizing a high performance regulator which takes advantage of CMOS fabrication processes in order to provide low noise, stable operation, and low-ripple voltage regulation without requiring tradeoffs between current efficiency and stability.

SUMMARY OF THE INVENTION

The present invention is an apparatus and method for an improved voltage regulator. A low drop-out (LDO) regulator, fabricated in a standard CMOS process, with new dynamic compensation, low noise, high open-loop gain, and high PSRR is introduced in the present invention. The regulator has a small silicon area requirement because it uses a low value internal compensation capacitor. Moreover, the architecture stabilizes the regulator operation without altering the noise, power supply rejection ratio (PSRR), or quiescent current performance. The circuit architecture of the present invention makes a pole-zero doublet frequency and unity gain frequency (UGF) of the regulator vary at the same rate with respect to a current load $I_L$; in particular, the pole-zero doublet frequency and the unity gain frequency are made to vary in proportion to the square root of the load current (i.e., $\sqrt{I_L}$). The variation is accomplished by making a zero stabilizing resistor Rz and first stage amplifier gain a decreasing function of $I_L$. The zero stabilizing resistor Rz is realized by means of an NMOS transistor having a gate terminal connected to a voltage which is dependent upon the current load $I_L$. The control of the first stage amplifier gain is accomplished by means of a PMOS transistor P214 (FIG. 2) to source an additional bias current. The gate terminal of the PMOS transistor P214 is connected to a potential which is dependent upon the current load $I_L$.

DETAILED DESCRIPTION OF THE INVENTION

Figure 1:
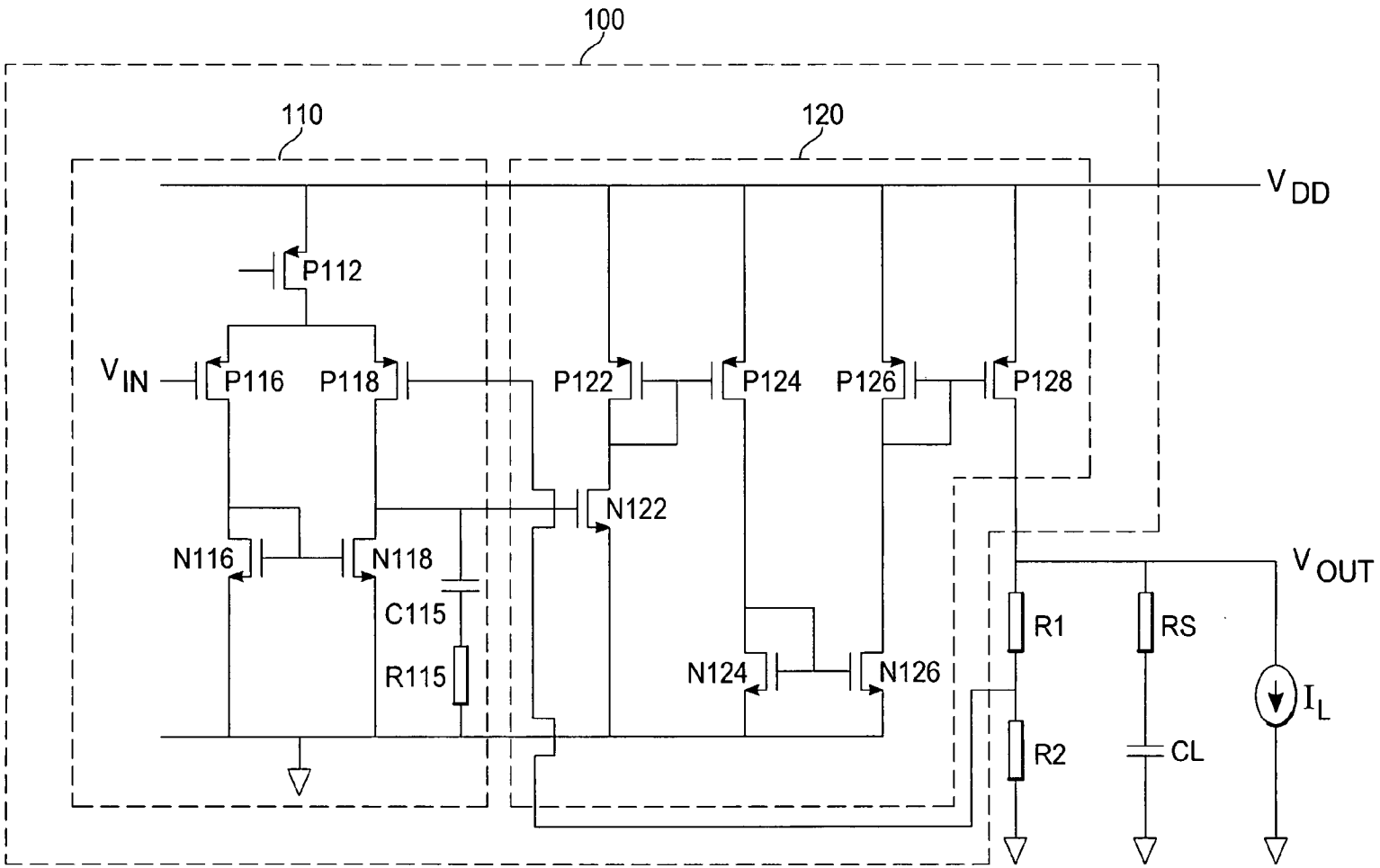
Fig. 1 (PRIOR ART)
FIG. 1 is a circuit schematic of a low drop-out (LDO) regulator as known in the prior art.
Figure 2:
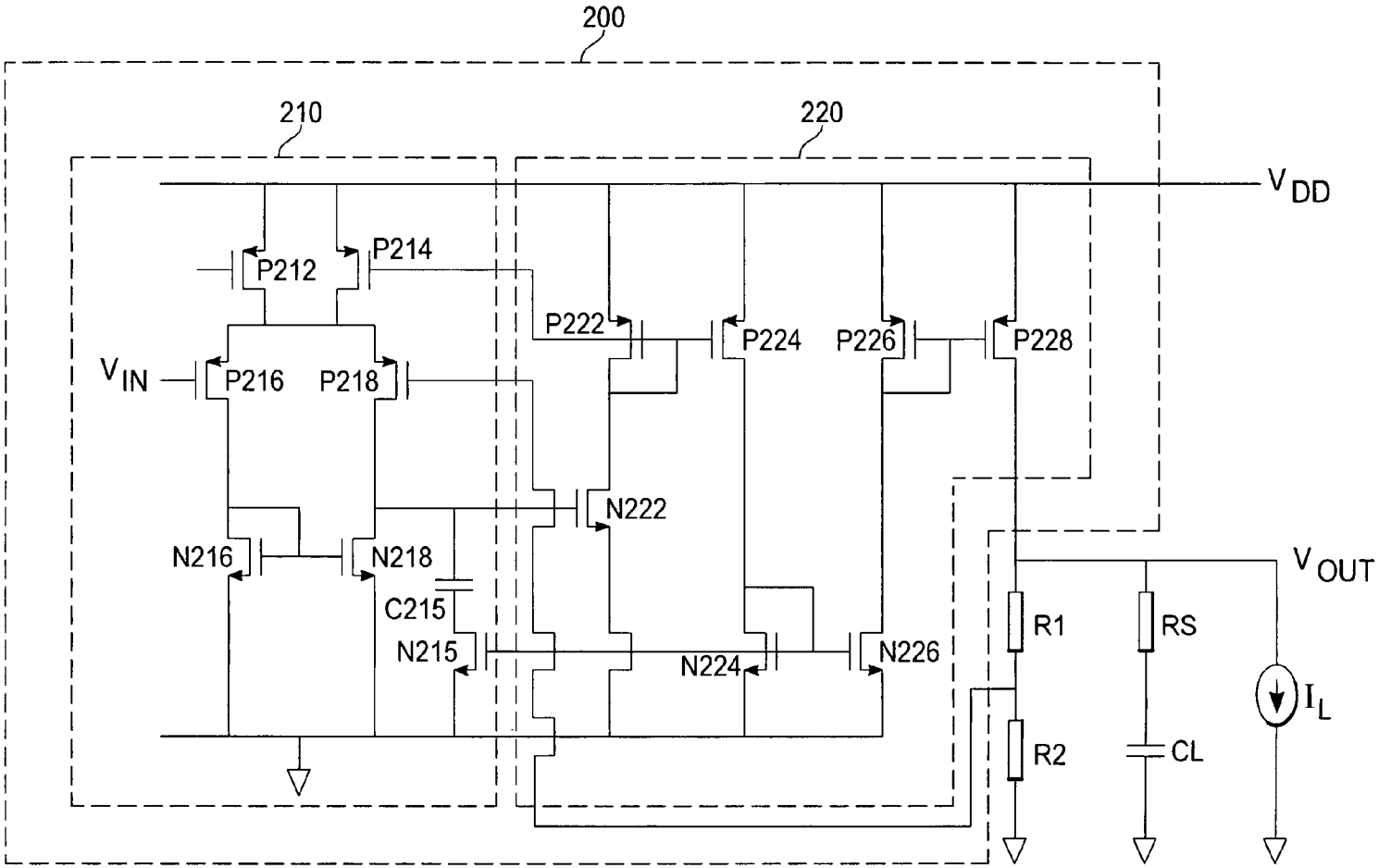
FIG. 2 is an exemplary circuit schematic of a low drop-out (LDO) regulator according to the present invention.

With reference to FIG. 2, exemplary regulator circuit 200 comprises a first amplifier stage 210 and a second amplifier stage 220. The first amplifier stage 210 comprises PMOS transistors P212, P214, P216, and P218. The first amplifier stage 210 further comprises a zero stabilizing capacitor C215, diode-connected NMOS transistor N216, resistor-like NMOS transistor N215 and NMOS transistor N218. The second amplifier stage 220 comprises diode-connected PMOS transistors P222 and P226, a PMOS transistor P224, a PMOS power transistor P228, a diode-connected NMOS transistor N224, and NMOS transistors N222 and N226.

The PMOS transistor P212 has its source terminal coupled to a first power supply potential VDD, its gate terminal coupled to a constant bias potential, and its drain terminal coupled to a drain terminal of PMOS transistor P214. The drain terminal of PMOS transistor P212 is further coupled to the source terminal of PMOS transistor P216 and to the source terminal of PMOS transistor P218. The PMOS transistor P214 has its source terminal coupled to the first power supply potential VDD, and its gate terminal coupled to the gate terminal of the PMOS transistor P222 and to the gate terminal of the PMOS transistor P224.

The PMOS transistor P216 has its gate terminal coupled to an input control voltage node VIN, and its drain terminal coupled to the drain and to the gate terminal of the diode-connected NMOS transistor N216. The gate terminal of the diode-connected NMOS transistor P216 is further coupled to the gate terminal of the NMOS transistor N218. Those skilled in the art will recognize that the diode-connected NMOS transistor N216 and the NMOS transistor N218 are configured to form a current mirror, which is characterized by a tendency to maintain a constant ratio of drain currents between the transistors comprising the current mirror. The PMOS transistor P218 has its drain terminal coupled to the drain terminal of the NMOS transistor N218, to the gate terminal of the NMOS transistor N222, and to a first terminal of the zero stabilizing capacitor C215. The diode-connected NMOS transistor N216, the NMOS transistor N218, and the resistor-like NMOS transistor N215 have their source terminals coupled to a second power supply potential GND. The resistor-like NMOS transistor N215 has its drain terminal coupled to a second terminal of the zero stabilizing capacitor C215. The gate terminal of the resistor-like NMOS transistor N215 is coupled to the gate terminal of the diode-connected NMOS transistor N224 and to the gate terminal of the NMOS transistor N226.

The source terminals of the diode-connected PMOS transistors P222 and P226, the source terminal of PMOS transistor P224, and the source terminal of PMOS power transistor P228 are coupled to the first power supply potential VDD. The drain terminal and the gate terminal of the diode-connected PMOS transistor P222 are coupled to each other, to the gate terminal of the PMOS transistor P224, and to the drain terminal of the NMOS transistor N222. Skilled artisans will recognize that the diode-connected PMOS transistor P222, the PMOS transistor P224, and the PMOS transistor P214 are configured in the form of a current mirror. In the analyses to follow infra, it is assumed that the current mirror ratio $k_1$ applies such that $k_1=W_{P224}/W_{P222}$. Furthermore, a current mirror ratio $k_3=W_{P214}/W_{P222}=k_1*W_{P214}/W_{P224}$ is assumed to apply.

The gate terminal and the drain terminal of the diode-connected NMOS transistor N224 are coupled to each other, to the drain terminal of the PMOS transistor P224, to the gate terminal of the NMOS transistor N226, and to the gate terminal of the resistor-like NMOS transistor N215. The source terminals of the NMOS transistor N222, the diode-connected NMOS transistor N224, and the NMOS transistor N226 are coupled to the second power supply potential GND. Skilled artisans will recognize that the diode-connected NMOS transistor N224, the NMOS transistor N226, and the resistor-like NMOS transistor N215 are configured in the form of a current mirror. In the analyses to follow infra, it is assumed that the current mirror ratio $k_2$ applies such that $k_2=W_{N226}/W_{N224}$.

The drain terminal and the gate terminal of the diode-connected PMOS transistor P226 are coupled to each other, to the gate terminal of the PMOS power transistor P228, and to the drain terminal of the NMOS transistor N226. The drain terminal of the PMOS power transistor P228 is coupled to the output controlled voltage node $V_{OUT}$. The PMOS power transistor P228 the diode-connected PMOS transistor P226 are configured in the form of a current mirror. In the analyses to follow infra, it is assumed that the current ratio $\alpha$ applies such that $\alpha=W_{P226}/W_{P228}$.

The output controlled voltage node $V_{OUT}$ is coupled to a first terminal of the resistor R1. A second terminal of the resistor R1 is coupled to the gate terminal of the PMOS transistor P218 and to a first terminal of the resistor R2. A second terminal of the resistor R2 is coupled to the second power supply potential GND. The configuration of the resistors R1 and R2 creates a voltage divider circuit, with the input voltage terminal being the output controlled voltage node $V_{OUT}$ and the divided voltage coupled to the gate terminal of the PMOS transistor P218. The divided voltage coupled to the gate terminal of the PMOS transistor P218 provides a feedback signal into the first amplifier stage 210.

The decoupling capacitance $C_L$ and an equivalent series resistance (ESR) $R_S$ are coupled between the output controlled voltage node $V_{OUT}$ and the second power supply potential GND. A first terminal of the equivalent series resistance (ESR) $R_S$ is coupled to the output controlled voltage node $V_{OUT}$ and a second terminal of the equivalent series resistance (ESR) $R_S$ is coupled to a first terminal of the decoupling capacitance $C_L$. A second terminal of the decoupling capacitance $C_L$ is coupled to the second power supply potential GND. Those skilled in the art will appreciate that the equivalent series resistance (ESR) $R_S$ may not be physically separate from the decoupling capacitance $C_L$, but may represent a parasitic electrical characteristic resulting from physical attributes inherent to the decoupling capacitance $C_L$ itself. The representation of the equivalent series resistance (ESR) $R_S$ as a separate component facilitates design and analysis of the regulator circuit 200.

The current load $I_L$ has a first terminal coupled to the controlled output voltage node $V_{OUT}$ and a second terminal coupled to the second power supply potential VDD.

Those skilled in the art will recognize that the resistors R1 and R2, as well as the external decoupling capacitance $C_L$ and its associated equivalent series resistance (ESR) $R_S$, may be external to the voltage regulator 200, or may be optionally integrated onto the same substrate, and even into the regulator circuit itself, by known techniques.

A discussion and analysis of the architecture of the regulator circuit 200 is now presented for an exemplary embodiment of the present invention. A novel approach is to make the pole-zero doublet (pc, zc) and the unity-gain frequency (UGF) vary at the same rate of the current load $I_L$. More specifically, the pole-zero doublet (pc, zc) and the unity-gain frequency (UGF) are made to vary in proportion to the square root of the current load $I_L$ (i.e., $\sqrt{I_L}$). In order to provide the variation, the fixed-value zero stabilizing resistor R115 (FIG.

1) in the prior art, c.f., formulae (10) and (12), is made to vary with load current. The resistance variation with load current is accomplished in the present invention by the resistor-like NMOS transistor N215 acting as a variable resistor. The gate terminal of the NMOS transistor N224 exhibits a potential which depends on the value of the current load $I_L$, to be shown infra, and is coupled to the gate terminal of the resistor-like NMOS transistor N215 to provide control of the variable resistor action. The NMOS transistor N226 operates in saturation and the following relation applies:

$$Vgs_{P228} - Vtn = \sqrt{\frac{2a * I_L}{k_2 * K_n} * \frac{L_{N224}}{W_{N224}}} \tag{17}$$

In formula (17), $Vgs_{P228}$ represents the gate-to-source voltage of the PMOS power transistor P228, Vtn represents the threshold voltage for NMOS transistors, and $\alpha$, $k_2$, and $k_n$ were introduced supra.

The PMOS power transistor P228 operates in the linear region, with an output conductance given by the relation:

$$gds_{P228} = K_n * \frac{W_{P228}}{L_{P228}} * (Vgs_{P228} - Vtn) \tag{18}$$

Combination of formula (17) and formula (18) gives an expression for the resistance Rz presented by the NMOS transistor N215:

$$Rz = \frac{1}{gds_{P228}} = \frac{L_{P228}}{W_{P228}} * \frac{1}{\sqrt{\frac{L_{N224}}{W_{N224}} * \frac{2a * K_n}{k_2}}} * \frac{1}{\sqrt{I_L}} \tag{19}$$

Combining formula (19) and an analogous form of formula (10) gives an expression for the zero zc as an increasing function of $I_L$:

$$zc = \frac{1}{2\Pi * C215} * \frac{W_{P228}}{L_{P228}} * \sqrt{\frac{L_{N224}}{W_{N224}} * \frac{2a * K_n}{k_2}} * \sqrt{I_L} = \frac{1}{2\Pi * C215} Tz * \sqrt{I_L} \tag{20}$$

Formula (20) shows that the zero zc varies with the load current $I_L$ at the desired rate in proportion to $\sqrt{I_L}$. The variable Tz is introduced as a simplification for writing the expression in a more compact form.

The next attribute to be demonstrated for the present invention is the controlled dependence of the pole p2 on the current load $I_L$. The p2 variation is introduced into the open-loop transfer function of the first amplifier stage 210, by the PMOS transistor P214, which sources a fraction of the current load $I_L$ into the first amplifier stage 210. First, we consider a transconductance $gm_{P218}$ of a differential pair formed by the PMOS transistors P216 and P218:

$$gm_{P218} = \sqrt{\frac{a * k_3}{k_1 * k_2}} * \sqrt{2 * K_p * I_L * \frac{W_{P218}}{L_{P218}}} \tag{21}$$

The output admittance of the first stage amplifier 210 is determined by addition of the admittances of the PMOS transistor P218 and the NMOS transistor N218 according to the relation:

$$gd_{P218} + gd_{N218} = (\lambda_{P218} + \lambda_{N218}) * \frac{\alpha * k3}{k1 * k2} * I_L \tag{22}$$

In formula (22), $\lambda_{P218}$ represents the channel modulation parameter for the PMOS transistor P218 and $\lambda_{N218}$ represents the channel modulation parameter for the NMOS transistor N218. Furthermore, as described supra, $k_3$ is the ratio of the device widths for the PMOS transistors P222 and P214 such that $k_3 * W_{P222} = W_{P214}$.

In an exemplary embodiment of the present invention, the resistance Rz is designed such that:

$$Rz * (gd_{P218} + gd_{N218}) << 1 \tag{23}$$

In the exemplary embodiment formula (23) is valid for all values of the current load $I_L$. When formula (23) is valid, formulae (9) and (11) can be simplified by application of formula (22) giving:

$$p2 = \frac{2}{2\Pi} * \frac{\lambda_{P218} + \lambda_{N218}}{C215 + C_{N222}} * \frac{\alpha * k_3}{k_1 * k_2} * I_L \tag{24}$$

$$\frac{pc}{zc} = \frac{C215}{C_{N222}} + 1 \tag{25}$$

Figure 3:
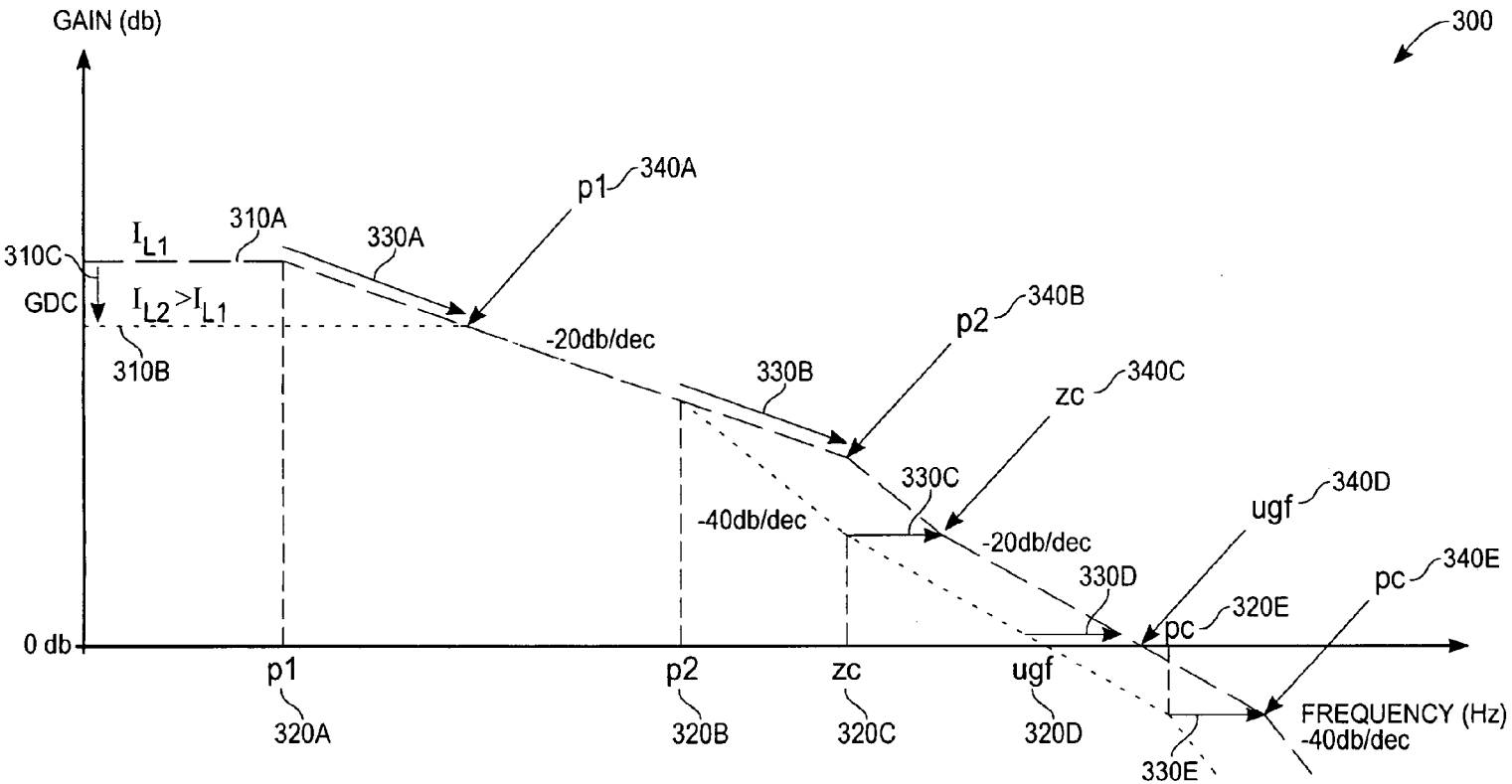
FIG. 3 is a conceptual gain vs. frequency plot of a regulator circuit according to the present invention.

A digression is now made to FIG. 3, a conceptual gain vs. frequency plot 300 for the regulator circuit 200 according to an exemplary embodiment of the present invention. Conceptual gain vs. frequency plot 300 includes a gain vs. frequency response line 310A corresponding to a current load $I_{L1}$ and a gain vs. frequency response line 310B corresponding to a current load $I_{L2}$ such that $I_{L2} > I_{L1}$. The arrow 310C indicates a relative shift in the dc gain GDC as a function of increasing load current. Initial positions 320A-320E indicate locations of pole p1, pole p2, zero zc, unity gain frequency (UGF), and pole pc respectively, all corresponding to the current load $I_{L1}$. Arrows 330A-330E indicate respective motions of pole p1, pole p2, zero zc, unity gain frequency (UGF), and pole pc, respectively, as the load current increases from $I_{L1}$ to $I_{L2}$. Final positions 340A-340E indicate locations of pole p1, pole p2, zero zc, unity gain frequency (UGF), and pole pc respectively, corresponding to the current load $I_{L2}$.

Reference to formulae (24), (25), and to FIG. 3 shows that the pole p2 is a function of the current load $I_L$, and that a splitting ratio pc/zc, associated with the pole-zero doublet (pc, zc), is independent of the current load $I_L$, but depends predominantly on the capacitance ratio C115/$C_{N222}$. As discussed in the first journal publication by Gabriel A. Rincon-Mora and Phillip E. Allen, the gain-bandwidth product of the first amplifier stage 210, $$\left(\frac{gm_{P218}}{gd_{P218} + gd_{N218}} * p2\right),$$

is a function of $\sqrt{I_L}$. Since the dc gain of the first amplifier stage 210 decreases with increasing load current, the power supply rejection ratio (PSRR) as a function of frequency is improved from the prior art regulator circuit 100.

Using formulae (21) and (22), the DC gain may be written as a function of the current load:

$$G_{DC} = \sqrt{\frac{k_1 * k_2}{\alpha * k_3}} * \sqrt{2 * K_p * \frac{W_{P218}}{L_{P218}}} * \frac{1}{\lambda_{P218} + \lambda_{N218}} * \frac{\sqrt{2 * K_n * \frac{k_1 * k_2}{\alpha} * \frac{W_{N222}}{L_{N222}}}}{\lambda} * \frac{R1}{R2} * \frac{1}{I_L} \tag{26}$$

By substitution of formulae (26), (3), (20), and (24) into formula (16), the unity gain frequency (UGF) of the exemplary regulator circuit 200 open-loop transfer function can be written as:

$$UGF = \frac{C215}{2\Pi * C_L} * \sqrt{\frac{\alpha * k_3}{k_1 * k_2}} * \sqrt{2 * K_p * \frac{W_{P218}}{L_{P218}}} * \sqrt{2 * K_n * \frac{k_1 * k_2}{\alpha} * \frac{W_{N222}}{L_{N222}}} * \frac{R2}{R1 + R2} * \frac{1}{Tz} * \frac{1}{C215 + C_{N222}} * \sqrt{I_L} \tag{27}$$

Formula (27) demonstrates that the variation of the unity gain frequency (UGF) with current load $I_L$ is in proportion to the square root of the current, $\sqrt{I_L}$, matching the variation of the introduced pole-zero doublet (pc, zc).

The phase margin (PM) for the regulator circuit 200 is independent of the current load I230 and can be expressed as:

$$PM = \arctan\left(\frac{UGF}{zc}\right) - \arctan\left(\frac{UGF}{pc}\right) = \arctan\left(\frac{UGF * (pc - zc)}{zc * pc + UGF^2}\right) \tag{28}$$

An analysis of the phase margin (PM) as a function of the unity gain frequency (UGF) gives an optimal (i.e., maximum) phase margin when:

$$UGF = \sqrt{zc * pc} = zc * \sqrt{\frac{C215}{C_{N222}} + 1} \tag{29}$$

The conditions for optimal phase margin can be calculated for the W/L ratio of the PMOS power transistor P224, $W_{P224}/L_{P224}$, by equating formulae (27) and (29) and applying formula (20). The ratio $W_{P224}/L_{P224}$ is independent of $\lambda_{P218}$ and $\lambda_{N218}$, permitting reduction of $\lambda_{P218}+\lambda_{N218}$ to ensure that the condition required by formula (23) is satisfied, regardless of the current load $I_L$. Substitution of formula (29) into formula (28) gives:

$$PM = \arctan\left(\frac{1}{2} * \sqrt{\frac{C215}{C_{N222}} * \frac{C215}{C215 + C_{N222}}}\right) \tag{30}$$

The phase margin PM is a monolithic increasing function of zero stabilizing capacitor C215. The value of zero stabilizing capacitor C215 is chosen as large as possible, consistent with meeting the power supply rejection ratio (PSRR) requirement for the regulator circuit. Selection of zero stabilizing capacitor C215 as large as possible establishes the best compromise between regulator stability and PSRR performance. As an example, if the ratio C215/$C_{N222}$ equals 10, then application of formula (30) predicts a phase margin (PM) of 60 degrees.

Figure 4:
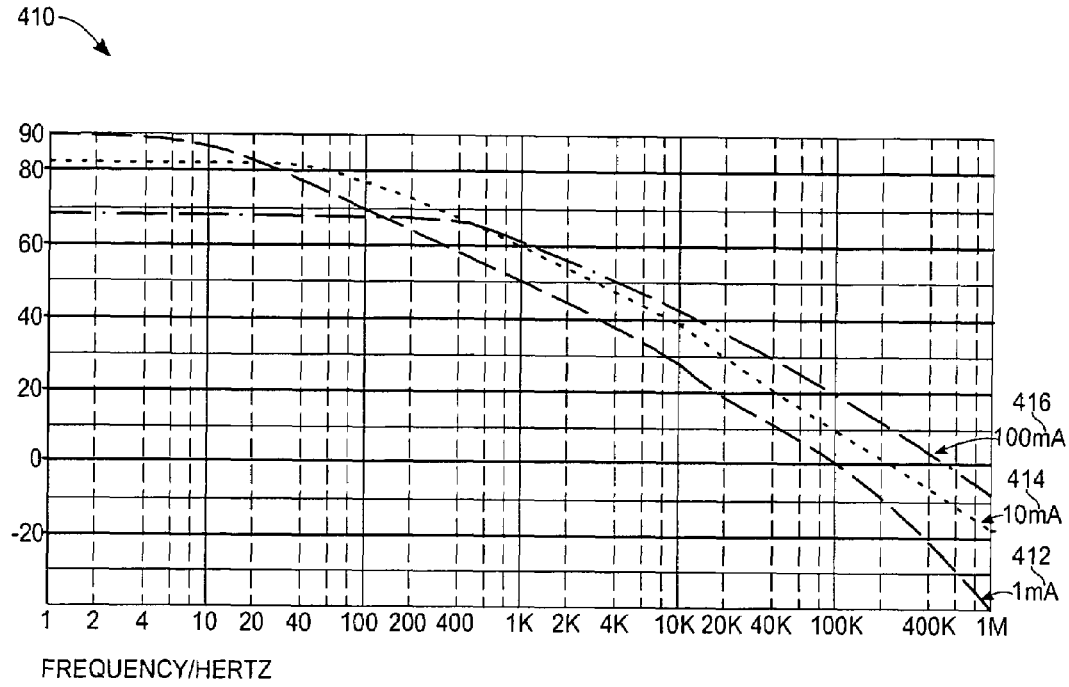
FIG. 4 is a simulated frequency response plot of a regulator circuit in accordance with the present invention.
Figure 4:
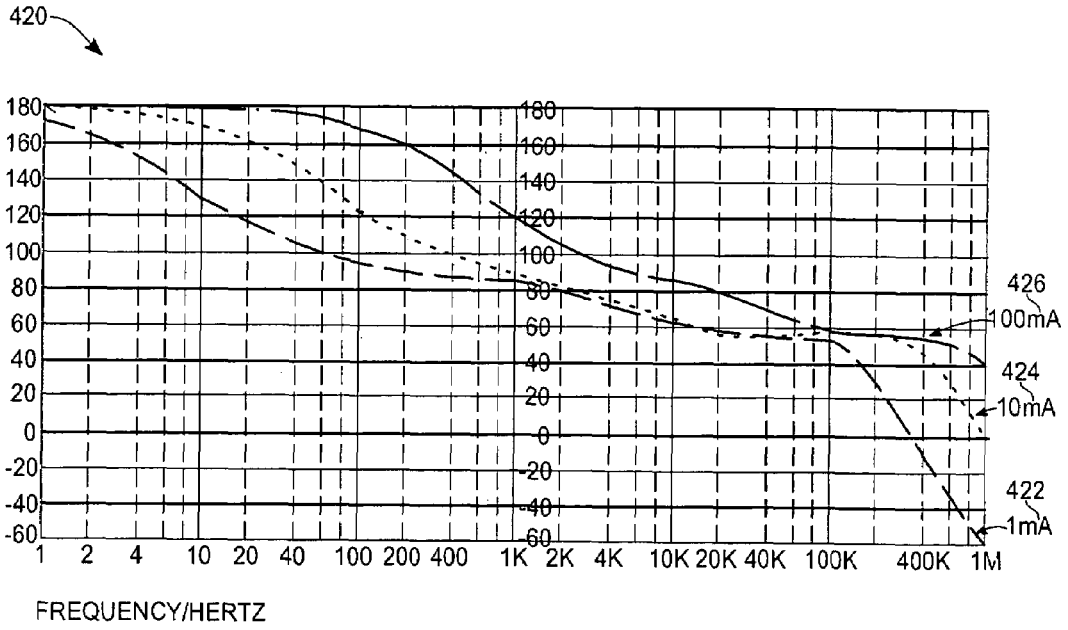

With reference to FIG. 4, a simulated frequency response plot of the exemplary regulator circuit 200 according to the present invention comprises a gain versus frequency plot 410 and a phase versus frequency plot 420. Frequency response predictions of the type in FIG. 4 are commonly performed using a variety of circuit simulation tools familiar to those skilled in the art. A gain versus frequency curve 412 is the simulation prediction for the regulator circuit 200 response when supplying a current load equal to 1 mA. A gain versus frequency curve 414 is the simulation prediction for the exemplary regulator circuit 200 response when supplying a current load equal to 10 mA. A gain versus frequency curve 416 is the simulation prediction for the regulator circuit 200 response when supplying a current load equal to 100 mA. A phase shift versus frequency curve 422 is the simulation prediction for the exemplary regulator circuit 200 response when supplying a current load equal to 1 mA. A phase shift versus frequency curve 424 is the simulation prediction for the exemplary regulator circuit 200 response when supplying a current load equal to 10 mA. A phase shift versus frequency curve 426 is the simulation prediction for the exemplary regulator circuit 200 response when supplying a current load equal to 100 mA.

A comparison of simulated and experimentally measured performance for the exemplary regulator circuit 200 is summarized in the following table:

| Parameter | Conditions | Simulated Results | Measured results | Unit |
|---|---|---|---|---|
| Output voltage | | 2.85 | 2.85 | V |
| Quiescent Current | $I_L$ = 0 mA<br>$I_L$ > 10 mA | 32<br>0.7% of Iload | 35<br>1% of Iload | μA |
| 20 kHz Power Supply Rejection | VDD = 3.6 V<br>$I_L$ = 100 mA<br>VDD = 3.2 V<br>$I_L$ = 100 mA | −64<br><br>−58 | −62<br><br>−55 | dB |
| 100 kHz Power Supply Rejection | VDD = 3.6 V<br>$I_L$ = 100 mA<br>VDD = 3.2 V<br>$I_L$ = 100 mA | −61<br><br>−55 | −59<br><br>−52 | dB |
| Output Noise (filtered bandgap included) | BW:<br>10 Hz to 100 kHz | 25 | 26 | $\mu V_{rms}$ |

In the foregoing specification, the invention has been described with reference to specific embodiments thereof. It will, however, be evident to a skilled artisan that various modifications and changes can be made thereto without departing from the broader spirit and scope of the invention as set forth in the appended claims. For example, the first and second amplifier stages may be integrated onto a single substrate, or they may be optionally fabricated as separately packaged circuit components. Other components, e.g., the resistive divider or decoupling capacitance, may optionally be included with the fabricated regulator circuit, or may be provided separately. The specification and drawings are, accordingly, to be regarded in an illustrative rather than a restrictive sense.

What is claimed is:

1. A voltage regulator circuit comprising:

a first amplifier stage having a first amplifier input terminal, a first amplifier output terminal, a feedback terminal, a pole-inducing transistor, and a compensation network coupled to the output terminal, the compensation network having a compensating capacitor and compensating transistor;

a second amplifier stage having a second amplifier input terminal coupled to the first amplifier output terminal, a first current mirror, a second current mirror, and a pass transistor coupling a first power supply potential to an output terminal, the first current mirror conducting a fraction of a load current supplied by the pass transistor, and the second current mirror conducting a fraction of the current supplied by the first current mirror;

a conduction path coupling the compensating transistor to the first current mirror; and a conduction path coupling the pole-inducing transistor to the second current mirror.

2. The regulator circuit of claim 1, wherein the pole-inducing transistor is a PMOS transistor coupled to a first power supply potential and sourcing a current into the first amplifier stage equal to a proportion of a load current supplied by the regulator circuit.

3. The regulator circuit of claim 2, wherein the first amplifier input terminal is a gate terminal of an input PMOS transistor and the feedback terminal is a gate terminal of a feedback PMOS transistor, the input PMOS transistor and the feedback PMOS transistor each having source terminals coupled to each other and to a drain terminal of the pole-inducing transistor.

4. The regulator circuit of claim 2, wherein the compensating transistor is an NMOS compensating transistor coupled to a second power supply potential and operating as a resistor in a series configuration with the compensating capacitor, the gate terminal of the NMOS compensating transistor having a potential which is dependent upon the load current supplied by the regulator circuit.

5. A method of frequency compensating a voltage regulator circuit, the voltage regulator circuit having a first stage amplifier and a second stage amplifier, the method comprising:

varying a unity gain frequency of an open-loop system transfer function of the regulator circuit such that the unity gain frequency increases in approximate proportion to the square root of a load current supplied by the voltage regulator circuit;

introducing a pole-zero doublet at an output of the first stage amplifier such that the frequency associated with the pole-zero doublet increases in approximate proportion to the square root of the load current, and such that a splitting ratio of the pole-zero doublet is substantially invariant with the load current; and introducing a second pole into an open-loop transfer function of the first stage amplifier, such that the second pole frequency is approximately proportional to the load current.

6. The method of claim 5, wherein the step of introducing the pole-zero doublet comprises an NMOS transistor operating as a resistor in a resistor-capacitor (RC) configuration, the resistance of the NMOS transistor decreasing in approximate proportion to the reciprocal value of the square root of the load current.

7. The method of claim 6, wherein the step of operating the NMOS transistor as a resistor comprises coupling a gate terminal of the NMOS transistor to a current mirror conducting a fraction of the load current supplied by the regulator circuit.

8. The method of claim 5, wherein the step of introducing the second pole into the open-loop transfer function of the first stage amplifier comprises sourcing a current equal to a proportion of the load current into the first stage amplifier.

9. The method of claim 8, wherein the step of sourcing the proportion of the load current comprises a PMOS transistor having a gate terminal coupled to a current mirror conducting a fraction of the load current supplied by the regulator circuit.

10. A method of frequency compensating a voltage regulator circuit, the voltage regulator circuit having a first stage amplifier and a second stage amplifier, the method comprising: p1 varying a unity gain frequency of an open-loop system transfer function of the regulator circuit such that the unity gain frequency increases in direct proportion to a frequency associated with a pole-zero doublet introduced at an output of the first stage amplifier; and maintaining a splitting ratio of the pole-zero doublet such that the splitting ratio is substantially invariant with a load current supplied by the voltage regulator current.

11. The method of claim 10, further comprising:

introducing a second pole into an open-loop transfer function of the first stage amplifier, such that the second pole frequency is approximately proportional to the load current.

12. The method of claim 11, wherein the unity gain frequency and the frequency associated with the pole-zero doublet each increase in proportion to the square root of the load current.

13. A low drop-out (LDO) voltage regulator circuit comprising:

a first amplifier means for accepting an input voltage and a feedback voltage, the first amplifier means providing a first amplifier output signal;

a second amplifier means coupled to the first amplifier means and accepting the first amplifier output signal, the second amplifier means providing coupling between a first power supply potential and an output terminal;

a zero compensation means for introducing a pole-zero doublet at the first amplifier output signal, the pole-zero doublet having a frequency increasing in approximate proportion to the square root of a load current supplied by the regulator circuit, the pole-zero doublet further having a splitting ratio essentially invariant with the load current;

a second pole introduction means for introducing a second pole into an open-loop transfer function of the first amplifier means, a frequency of the second pole increasing in approximate proportion to the load current; and a unity gain control means for increasing a unity gain frequency of an open-loop transfer function of the regulator circuit in approximate proportion to the square root of the load current.

14. A voltage regulator circuit comprising:

a first amplifier stage having a first amplifier input terminal, a first amplifier output terminal, a feedback terminal, a pole-inducing transistor, and a compensation network coupled to the output terminal, the compensation network having a compensating capacitor and compensating transistor;

a second amplifier stage having a second amplifier input terminal coupled to the first amplifier output terminal, a first current mirror, a second current mirror, and a pass transistor configured to couple a first power supply potential to an output terminal, the first current mirror configured to conduct a fraction of a load current supplied by the pass transistor, and the second current mirror configured to conduct a fraction of the current supplied by the first current mirror;

a conduction path coupling the compensating transistor to the first current mirror; and a conduction path coupling the pole-inducing transistor to the second current mirror.

15. The regulator circuit of claim 14, wherein the pole-inducing transistor is a PMOS transistor coupled to a first power supply potential and configured to source a current into the first amplifier stage equal to a proportion of a load current supplied by the regulator circuit.

16. The regulator circuit of claim 15, wherein the first amplifier input terminal is a gate terminal of an input PMOS transistor and the feedback terminal is a gate terminal of a feedback PMOS transistor, the input PMOS transistor and the feedback PMOS transistor each having source terminals coupled to each other and to a drain terminal of the pole-inducing transistor.

17. The regulator circuit of claim 15, wherein the compensating transistor is an NMOS compensating transistor coupled to a second power supply potential and configured to operate as a resistor in a series configuration with the compensating capacitor, the gate terminal of the NMOS compensating transistor configured to have a potential which is dependent upon the load current supplied by the regulator circuit.

* * * * *

UNITED STATES PATENT AND TRADEMARK OFFICE

CERTIFICATE OF CORRECTION

PATENT NO. : 7,405,546 B2
APPLICATION NO. : 11/119130
DATED : July 29, 2008
INVENTOR(S) : Amrani et al.

It is certified that error appears in the above-identified patent and that said Letters Patent is hereby corrected as shown below:

In column 1, line 39, delete “LDOS"” and insert -- LDOs" --, therefor.

In column 3, line 10, delete “a” and insert -- *a* --, therefor.

In column 3, line 13, delete “a” and insert -- *a* --, therefor.

In column 3, line 50, delete “a” and insert -- *a* --, therefor.

In column 4, line 6, delete “a” and insert -- *a* --, therefor.

In column 4, line 25, delete “$P_2$” and insert -- $p_2$ --, therefor.

In column 5, line 26, delete “a” and insert -- *a* --, therefor.

In column 5, line 35, delete “a” and insert -- *a* --, therefor.

In column 5, line 48, delete “Cox” and insert -- $C_{ox}$ --, therefor.

In column 5, line 51, delete “Cox” and insert -- $C_{ox}$ --, therefor.

In column 5, line 56, delete “a” and insert -- *a* --, therefor.

In column 5, line 57, delete “Cox” and insert -- $C_{ox}$ --, therefor.

In column 5, line 65, delete “a” and insert -- *a* --, therefor.

In column 9, line 12, delete “2a” and insert -- 2*a* --, therefor.

In column 9, line 19, delete “$k_n$” and insert -- $K_n$ --, therefor.

In column 9, line 35, delete “2a” and insert -- 2*a* --, therefor.

In column 9, line 43, delete “2a” and insert -- 2*a* --, therefor.

In column 9, line 64, delete “a” and insert -- *a* --, therefor.

In column 10, line 26, delete “$\frac{2}{2_\pi}$” and insert -- $\frac{1}{2\pi}$ --, therefor.

UNITED STATES PATENT AND TRADEMARK OFFICE

CERTIFICATE OF CORRECTION

PATENT NO. : 7,405,546 B2
APPLICATION NO. : 11/119130
DATED : July 29, 2008
INVENTOR(S) : Amrani et al.

It is certified that error appears in the above-identified patent and that said Letters Patent is hereby corrected as shown below:

In column 10, line 40, delete "GDC" and insert -- $G_{DC}$ --, therefor.

In column 14, line 15, in Claim 10, before "varying" delete "p1".

Signed and Sealed this

Eighteenth Day of November, 2008

JON W. DUDAS
*Director of the United States Patent and Trademark Office*